US006925950B2

(12) United States Patent
Baudet

(10) Patent No.: US 6,925,950 B2
(45) Date of Patent: Aug. 9, 2005

(54) COMPOSITE ISO-STRESS SAIL STRUCTURE AND METHOD FOR MAKING

(76) Inventor: Jean-Pierre Baudet, P.O. Box 8216, Emeryville, CA (US) 94662-0126

( * ) Notice: Subject to any disclaimer, the term of this patent is extended or adjusted under 35 U.S.C. 154(b) by 0 days.

(21) Appl. No.: 10/349,489

(22) Filed: Jan. 22, 2003

(65) Prior Publication Data

US 2003/0213421 A1 Nov. 20, 2003

Related U.S. Application Data

(60) Provisional application No. 60/350,492, filed on Jan. 22, 2002.

(51) Int. Cl.[7] ..... B63H 9/04
(52) U.S. Cl. ..... 114/102.31
(58) Field of Search ..... 114/102.29, 102.31, 114/102.33

(56) References Cited

U.S. PATENT DOCUMENTS

| | | | | | |
|---|---|---|---|---|---|
| 3,274,968 | A | * | 9/1966 | Hayes et al. | 114/102.33 |
| 3,903,826 | A | | 9/1975 | Andersen | |
| 3,954,076 | A | | 5/1976 | Fracker | |
| 4,476,799 | A | * | 10/1984 | Bandy | 114/102.33 |
| 4,593,639 | A | | 6/1986 | Conrad | |
| 4,672,907 | A | * | 6/1987 | Smale | 114/102.33 |
| 4,708,080 | A | | 11/1987 | Conrad | |
| 5,038,700 | A | | 8/1991 | Conrad | |
| 5,097,784 | A | | 3/1992 | Baudet | |
| 5,172,647 | A | * | 12/1992 | Towne | 114/102.31 |
| 6,112,689 | A | | 9/2000 | Baudet | |
| 6,265,047 | B1 | | 7/2001 | Chapuis et al. | |
| 6,302,044 | B1 | | 10/2001 | Baudet | |
| 6,302,045 | B1 | * | 10/2001 | Mahr | 114/102.33 |

FOREIGN PATENT DOCUMENTS

| | | | | |
|---|---|---|---|---|
| EP | 271215 A1 | * | 6/1988 | B63H/9/06 |
| FR | 2 539 100 A1 | | 7/1984 | |

OTHER PUBLICATIONS

"Sailcloth the power in the rig," Yachts and Yachting, Apr. 12, 1999, pp. 33–39.

* cited by examiner

*Primary Examiner*—Andrew D. Wright
(74) *Attorney, Agent, or Firm*—James F. Hann; Haynes Beffel & Wolfeld LLP

(57) ABSTRACT

A composite iso-stress sail structure comprises a sail body having an expected iso-stress line, when in a chosen sail shape and under a loading within a chosen range of loadings. An iso-stress element is laminated to the sail body material to create an iso-stress portion at a corner of the sail body. An edge of iso-stress portion is shaped to be at least generally parallel to the iso-stress line. The iso-stress portion extends from the corner along at least one of the sides of the sail distances greater than 20% of the lengths of the sides, respectively.

41 Claims, 2 Drawing Sheets

COMPOSITE ISO-STRESS SAIL STRUCTURE AND METHOD FOR MAKING

This application claims benefit of U.S. Provisional Application No. 60/350,492 filed 22 Jan. 2002.

FIELD OF THE INVENTION

Various types of sail craft, such as sailboats, iceboats and sailboards, all use different types of sails for all or part of their motive force. Sails can be flat, two-dimensional sails or contoured, three-dimensional sails. Three-dimensional sails can be one-piece, seamless molded sails or, more typically, can be made by broadseaming a number of panels. The panels, each being a finished sector of sailcloth, are cut on a curve and assembled to one another to create the three-dimensional aspect for the sail.

Sailmakers attempt to develop stretch resistant sail structure that addresses both the sail loading direction and intensities to control the shape of the sail to maximize sail craft speed. One type of sail structure, called the triradial construction, uses several sections, each section made from narrow, pre-assembled radiating panels. The highly loaded sections of the sail, such as the clew, the head and the leech sections, are typically made with radial panels cut from heavy sail cloth. The lesser loaded sail sections, such as the luff and the tack sections, may be made with panels cut from lighter sail cloth. While triradial constructions fairly well follow the load lines, it may be difficult to vary cloth strength efficiently along the load lines.

Leech plying is an attempt to reinforce the sail by sewing a ply of finished sail cloth onto the back of the sail. This approach suffers from the fact that it can be very time-consuming to construct and the added ply may shrink at a different rate than the rest of the sail, thus affecting the shape of the sail.

Another way of reinforcing the sail structure is the use structural tapes externally on top of the finished sail fabric. However, has been found that the sail cloth trapped between the tapes may tend to bulge when the sail is loaded, which can dramatically affect the desired sail shape.

A further method uses multiple individual radiating yarns laminated between films to form narrow panels of sailcloth. While this approach allows one to address both yarn direction and intensities, it relies on the use of relatively thick films to transfer load from panel to panel. The films have their own set of drawbacks. First, they are poor agents for transferring loads because of their low tensile modulus. Second, films add quite a bit of weight to the sail fabric without a significant contribution to the structural strength. Third, unlike many fibers, films have a tendency to memorize folds and creases, which can permanently and deleteriously affect the design sail shape.

A still further method of sail structure creates molded seamless sails. This construction method permits one to create a constant strain fabric simultaneously with the shaping and the making of the sail body. However, this approach is highly capital intensive.

Sail structures are also reinforced at their corners to increase the thickness of the sail at the corners to allow for ring attachments. Traditional corner patches are typically made from multiple layers of finished sail fabric stitched the sail corners. These may be engineered to address the change of stress intensity near the corners and provide the necessary thickness for strap corner rings and fittings. Conventional corner patches extend only a short distance along the edges of the sail, that is to a maximum of about 10–18% of the length of the edges. Although the shape of the outer edge of the corner patch may be cut to follow the anticipated local iso-stress lines at the corners of the sail, they are not designed to provide an iso-stress structure to the sail body beyond the immediate sail corner areas.

See U.S. Pat. Nos. 3,903,826; 3,954,076; 4,593,639; 4,708,080; 5,038,700; 5,097,784; 6,112,689; 6,265,047 and 6,302,044.

SUMMARY OF THE INVENTION

The present invention provides a simple and economical way of achieving substantially constant strain characteristics for a composite iso-stress sail structure. The present invention is designed to provide the sail body with an iso-stress structure and support far beyond the localized sail areas covered by the corner patches. A purpose of the invention is to give iso-stress characteristics to the sail body where needed from a sail-shape control standpoint. By doing this, the desired sail shape can last longer and the desired sail trim effects may be better obtained. While corner patches act as anchors for sail fittings by locally reinforcing the sail to prevent it from failure at the corner, the present invention acts as a shape control agent further away from the sail corners, and potentially along the entire length of an edge of the sail.

A first aspect of the invention is directed to a composite iso-stress sail structure comprising a sail body, placeable in a chosen sail shape, having an expected iso-stress line (a line of constant stress) when in a chosen sail shape and under at least one loading within a chosen range of loadings. The sail body includes a sail body material and an iso-stress element laminated to the sail body material to create an iso-stress portion extending from a corner of the sail body. The iso-stress portion includes an edge shaped to be at least generally parallel to the iso-stress line. The iso-stress portion extends from the corner along at least one of the sides of the sail distances greater than about 20% of the lengths of the sides, respectively.

The sail body may have a plurality of iso-stress lines and the iso-stress portion may include a plurality of iso-stress elements extending from a corner of the sail body to create layers of iso-stress elements at the corner. The plurality of iso-stress elements define a plurality of the edges shaped to be at least generally parallel to corresponding ones of the iso-stress lines.

A second aspect of the invention is directed to a method for making a composite iso-stress sail structure comprising selecting a chosen sail shape for a sail body, the sail body including first and second edges extending from a corner, the first and second edges having first and second lengths. An expected iso-stress line for the sail shape is determined when the sail shape is under at least one loading within a chosen range of loadings. The sail body is constructed so to comprise an iso-stress portion to create a composite iso-stress sail structure at the iso-stress portion. The constructing step also comprises choosing said the body material and an iso-stress element, shaping an edge of the iso-stress element to generally correspond to the iso-stress line, aligning the edge of the iso-stress element to at least generally parallel the iso-stress line, extending the iso-stress element from the corner along the first and second edges for first and second distances, laminating the sail body material and the iso-stress element to create the sail body with the iso-stress portion, and selecting at least one of the first and second distances to be at least 20% of the first and second lengths.

The method may be carried out in a manner so that a plurality of expected iso-stress lines are determined. The sail body may be constructed from sail body material and a plurality of layered iso-stress elements associated with the sail body material and extending from a corner of the sail body to create a layered iso-stress portion at the corner. The iso-stress portion may be formed in a manner so that the iso-stress portion is an effectively integral portion of the sail body. The iso-stress elements may constitute the edges of the iso-stress portion and may be shaped to generally correspond to the iso-stress lines. The edges of the iso-stress elements may be aligned so that they at least generally parallel corresponding ones of the iso-stress lines.

Other features and advantages of the invention will appear from the following description in which the preferred embodiments have been set forth in detail in conjunction with the accompanying drawings.

DETAILED DESCRIPTION OF THE INVENTION

Figure 1:
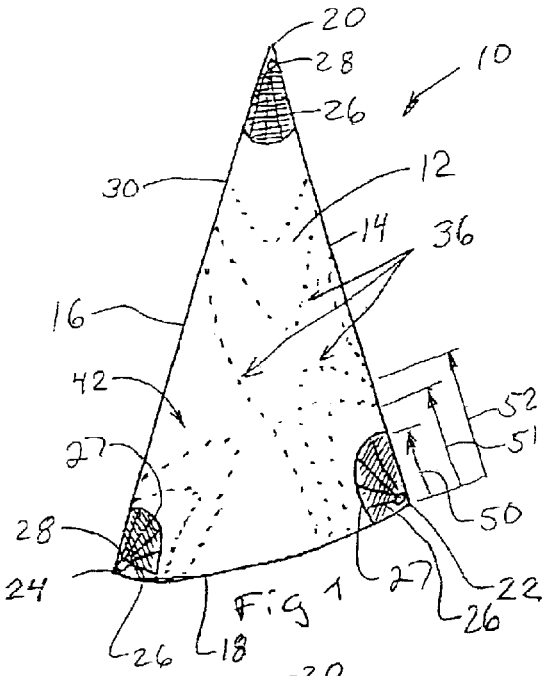
FIG. 1 is a plan view of a sail made according to the invention.

FIG. 1 illustrates a sail 10 made according to the invention. In this embodiment the sail includes a sail body 12 and has three edges, luff 14 (the forward or leading edge), leech 16 (the aft or trailing edge), and foot 18. Sail 10 also includes three corners, head 20 at the top, tack 22 at the lower forward corner of the sail at the intersection of luff 14 and foot 18, and clew 24 at the lower aft corner of the sail at the intersection of the leech and foot. It will be assumed for the purposes of this discussion that sail 10 is a 3-dimensional, molded, contoured sail; it could also be a 2-dimensional, flat sail. Also, sail 10 is made from a single section. Instead of a single section, the sail could include multiple sections such as discussed with reference to FIG. 5. Finished sail 10 includes conventional gussets or corner patches 26 at the three corners, to provide reinforcement for rings 28 through which lines are passed to secure sail 10 to the sailcraft, and selvage 30 along luff 14, leech 16 and foot 18.

Figure 2:
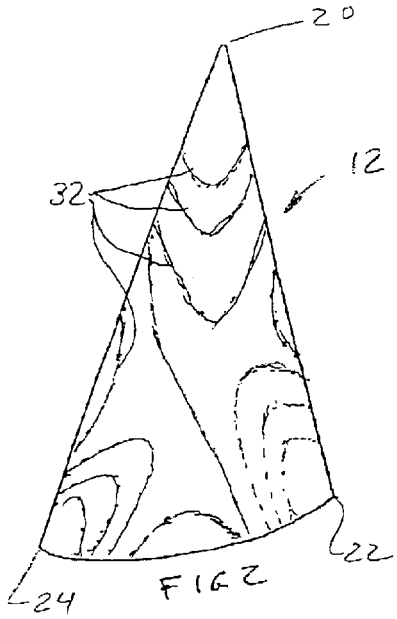
FIG. 2 is a plan view of the sail body of FIG. 1 with an exemplary set of expected iso-stress lines shown in dashed lines.

Through conventional stress analysis software, such as is available under the trademark Relax from Halsey Lidgard Sailmakers of San Mateo, Calif. and Auckland, New Zealand, load maps for sail body 12 may be obtained indicating stress directions and expected iso-stress lines 32, shown in FIG. 2, for various loading conditions under a range of loading conditions. Iso-stress lines 32 are similar to contour lines on a map and indicate where the stress on the sail body is the same. The expected iso-stress lines 32 are determined when sail body 12 is under at least one loading condition within a range of loading conditions. For example, one loading condition might assume a small multi-hull main sail sailing at 12 knots under 20 knots of wind and with the crew hiking out on a trapeze. (See FIG. 6.) Typically, the design loading condition is based on designing the sail to withstand the maximum stresses exerted over different portions of the sail under a range of loading conditions. Therefore, it may be that the local reinforcement extending from each corner of the sail body is based upon different loading conditions within the range of expected loading conditions. Therefore, the locations of the iso-stress lines 32 will change in according to the assumed loading conditions.

As is evident from FIG. 2, and as expected, sail body 12 needs more reinforcement in some places, such as at the corners, than others. The present invention recognizes the need for reinforcement at the corners and provides for reinforcement through the use of one or more layers of iso-stress elements 34, see FIGS. 3 and 4, in which the edges 36 of elements 34 follow chosen ones of the expected iso-stress lines 32. In the disclosed embodiment, iso-stress elements 34 are laminated using heat and/or pressure between first and second layers of sail material 38, 40. Alternatively, one or more iso-stress elements could be laminated to an outer surface of the sail material. For example, thick film polymers are often used for sail board sails; iso-stress portions 42 may be created by laminating one or more iso-stress elements 34 to the outside surface of the thick film polymers material. In any event, the iso-stress elements 34 are integrally secured to the sail material so that the iso-stress portions 42 are integral portions of sail body 12. The lamination may take place on a flat surface to create the flat sectors 44–47 of FIG. 5 or using three-dimensional molded techniques.

Typically, vacuum bagging techniques or autoclaving could be used to provide the necessary pressure while heat could be applied using one or more of a heated fluid, a heated surface or radiant heat.

The outer edges 27 of corner patches 26 are generally parallel to iso-stress lines. However, they are not intended to and do not act as shape-control agents for sail body 12.

The sail material may be made of conventional or unconventional materials, including conventional sailcloth, thick film polymers, fiber reinforced polymers or a combination thereof.

Iso-stress elements 34 may also be made using conventional or unconventional materials. Examples of materials for iso-stress elements 34 include precoated woven and unwoven scrims, ultralight precoated layers having a plurality of radiating yarns, precoated unidirectional yarn layers, and sectors and/or overlapping strips of one or more of the above. The materials used for making the sail material and the iso-stress elements 34 include, for example, carbon fibers, aramids, Spectra, pbo, Pentex, polyester, and ultralight precoated films.

Figure 3:
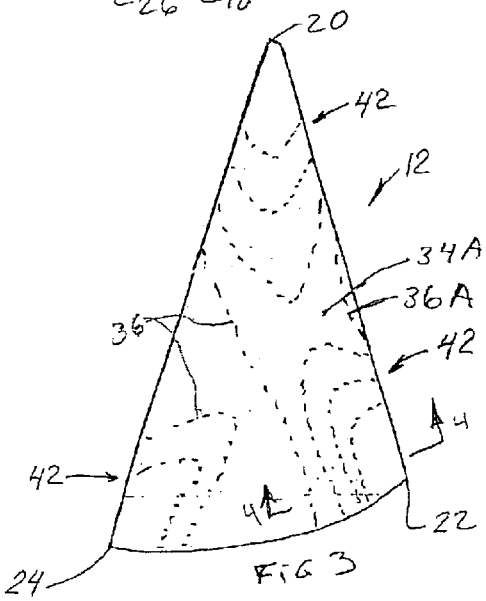
FIG. 3 shows a molded, three-dimensional sail body having iso-stress portions at each of the three corners, each of the iso-stress portions including layered iso-stress elements.
Figure 5:
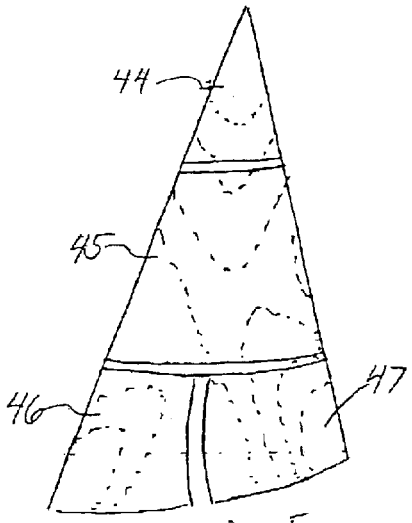
FIG. 5 illustrates two-dimensional (flat) sections which will be joined to create a three-dimensional sail body similar to that shown in FIG. 3.
Figure 4:
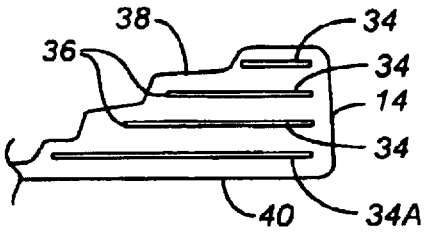
FIG. 4 is a cross-sectional view taken along line 4—4 of FIG. 3 illustrating four layers of iso-stress elements between first and second layers of material, the distances between the elements being exaggerated for clarity.

FIG. 5 illustrates four two-dimensional sections 44–47 prior to be joined to create a three-dimensional, contoured sail similar to that shown in FIG. 3. As is evident from FIG. 5, some of the iso-stress elements 34 are separated into two or more sections for lamination between the first and second layers 38, 40 of sail material for each sector 44–47. Conventional broad seaming techniques are used to join sectors 44–47 to create a three-dimensional sail body. After the sail body is finished, sail 10 may be finished by adding gussets 26, rings 28 and selvage 30.

It is important to recognize that the present invention provides much more than simply reinforcing the area of sail body 12 surrounding rings 28. The present invention creates a composite iso-stress sail structure using iso-stress elements 34 to extend from the corners significant distances along luff 14, leech 16 and foot 18. Typically, the distances along luff 14 from tack 22 or head 20 range from about 20%–60% of the length of luff 14. See, for example, distances 50, 51 and 52 in FIG. 1. Similarly, the distances along leech 16 from clew 24 or head 20 range from about 20%–60% of the length of leech 16. The distances along foot 18 from tack 22 or clew 24 range from about 15%–40% of the length of foot 18. If only a single layer of elements 32 is used at a corner, the distances along the sides are preferably about 60–100% of the length of luff 14/leech 16 and about 40–100% of the length of foot 18.

The preferred embodiment illustrates the use of three iso-stress elements 34 at head 20 and tack 22 and two iso-stress elements 34 at clew 24. An additional iso-stress element 34A extends between head 20 and tack 22. Other arrangements and numbers of iso-stress elements may be used, including use of zero or one iso-stress element 34 at a corner. In the preferred embodiment each iso-stress element 34 is made of the same material and has the same thickness; iso-stress elements 34 may be of different materials and/or of different differences.

Luff 14 is usually the edge of the sail under the least stress. However, as suggested by the curve of mast 56 in FIG. 6, sailors often pull on block and tackle 58 attached to ring 28 at tack 22 to control the bend of the mast. Doing so places luff 14 under a great deal of tension. To help accommodate this, iso-stress element 34A (which has a second edge 36A adjacent to luff 14) extends from tack 22 to head 20 along the length of luff 14 to help permit the sail to be used to control the bend of mast 56 through, for example, the use of block and tackle 58 connected to tack 22.

Figure 6:
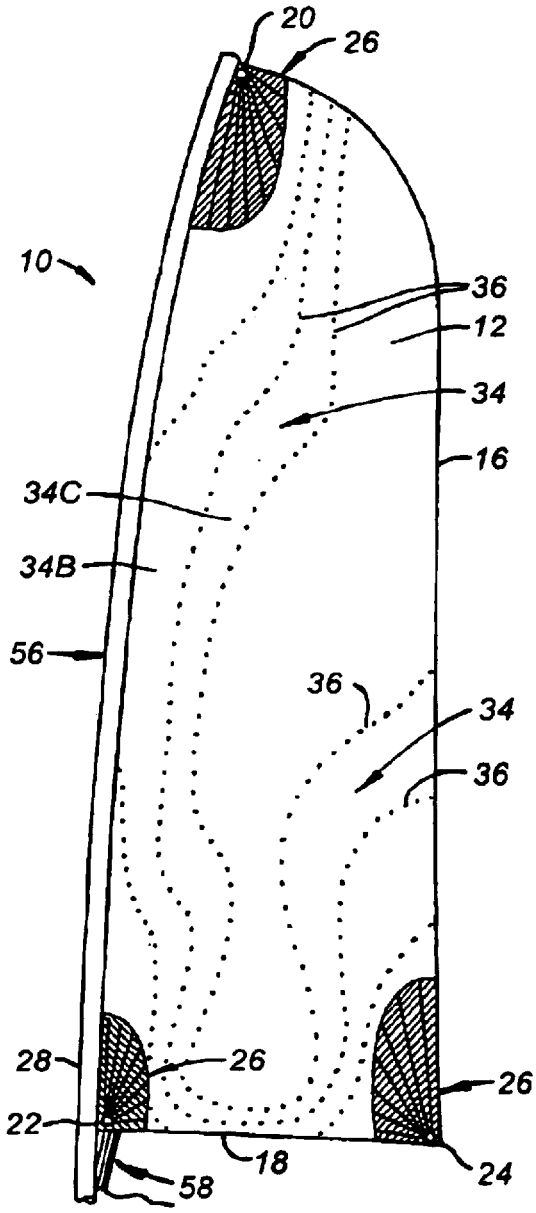
FIG. 6 illustrates a main sail made according to the invention mounted to a mast in which two of the iso-stress elements extend along the entire foot between the clew and the tack to help ensure that the foot remains straight during extreme loading conditions and along the entire luff between the tack and the head to provide additional strength to the luff to permit the sail to be used to control mast bend.

FIG. 6 illustrates an alternative embodiment of a sail body 12 made according to the invention with like reference numerals referring to like elements. The sail body 12 of FIG. 6 illustrates a main sail designed with two of iso-stress elements 34, identified as 34B and 34C in FIG. 6, extending along the entire foot 18 between the clew 24 and the tack 22. This extra reinforcement helps to ensure that the foot remains straight during extreme loading conditions. In addition, iso-stress elements 34B and 34C extend from tack 22 to head 20 to provide additional reinforcement along luff 14 to help permit the sail to be used to control the bend of mast 56, typically through the use of block and tackle 58 connected to tack 22.

Iso-stress elements 34 extend along at least one of the edges at least 20% of the length of the edge, and preferably along (a) at least about 25% of one of the edges, (b) at least 20% of both of the edges, (c) at least about 25% of both of the edges, (d) 20–60% of both of the edges, or (e) about 25–60% of both of the edges.

The present invention should adapt well to a variety of sail structures, including those disclosed in U.S. Pat. Nos. 6,112,689 and 6,302,044. The invention should also be well-suited for sail structures using, for example, large laminated sail sections, thermoformed molded sails, large sails such as large multi-hull roller-furling genakers, other genakers head sails and the main sails for smaller boats, sails for sail boards, and small one-design multi-hulls.

Modification and variation can be made to the disclosed embodiments without departing from the subject of the invention as defined the following claims. For example, it may not be necessary to use gussets 26 at one or more of the corners.

Any and all patents, patent applications and printed publications referred to above are incorporated by reference.

What is claimed is:

1. A composite iso-stress sail structure comprising:

a sail body, placeable in a chosen sail shape, comprising:

a plurality of expected iso-stress lines, said iso-stress lines determined when the sail shape is under at least one loading within a chosen range of loadings;

a corner;

first and second edges extending from the corner, said first and second edges having first and second lengths; and a sail body material and a plurality of iso-stress elements laminated to the sail body material to create an iso-stress portion extending from the corner along the first and second edges for first and second distances;

at least some of said plurality of iso-stress elements being layered one on top of one other;

the iso-stress elements comprising a plurality of edges shaped to be at least generally parallel to corresponding ones of said iso-stress lines; and at least one of said first and second distances being greater than 20% of the first and second lengths, respectively.

2. The sail structure according to claim 1 wherein at least one of said first and second distances is greater than about 25% of the first and second lengths, respectively.

3. The sail structure according to claim 1 wherein both of said first and second distances are greater than 20% of the first and second lengths, respectively.

4. The sail structure according to claim 1 wherein both of said first and second distances are greater than about 25% of the first and second lengths, respectively.

5. The sail structure according to claim 1 wherein at least one of said first and second distances is 20–60% of the first and second lengths, respectively.

6. The sail structure according to claim 1 wherein at least one of said first and second distances is about 25–60% of the first and second lengths, respectively.

7. The sail structure according to claim 1 wherein both of said first and second distances are 20–60% of the first and second lengths, respectively.

8. The sail structure according to claim 1 wherein both of said first and second distances are about 25–60% of the first and second lengths, respectively.

9. The sail structure according to claim 1 wherein the sail structure is a chosen one of a sailboat sail structure and a sailboard sail structure.

10. The sail structure according to 1 wherein each of the iso-stress elements extends from said corner.

11. The sail structure according to claim 10 wherein said sail body has first and second corners and at least one of said iso-stress elements extends from said first corner to said second corner.

12. The sail structure according to claim 1 wherein edges the iso-stress elements are generally aligned with corresponding ones of said iso-stress lines.

13. The sail structure according to claim 1 wherein the sail body material comprises layers of sail fabric and said iso-stress elements are laminated between the layers of said sail fabric to create said iso-stress portion.

14. The sail structure according to claim 1 wherein the sail body material comprises a polymer sheet and said iso-stress elements are laminated to the polymer sheet to create said iso-stress portion.

15. The sail structure according to claim 1 wherein the chosen sail shape is a flat, two-dimensional shape.

16. The sail structure according to claim 1 wherein the chosen sail shape is a curved, three-dimensional shape.

17. The sail structure according to claim 16 wherein the sail body is a one-piece, molded construction.

18. The sail structure according to claim 16 wherein the sail body is a multi-piece construction of sail body elements.

19. The sail structure according to claim 18 wherein the sail body elements are flat, two-dimensional elements prior to being constructed to form the sail body.

20. A composite iso-stress sail structure comprising:

a sail body, placeable in a chosen sail shape, comprising:

a plurality of expected iso-stress lines, said iso-stress lines determined when the sail shape is under at least one loading within a chosen range of loadings;

a corner and an iso-stress portion at the corner to create a composite iso-stress sail structure, the iso-stress portion of the sail body being an effectively integral portion of the sail body;

first and second edges extending from the corner, said first and second edges having first and second lengths; and sail body material and a plurality of layered iso-stress elements laminated to the sail body material and extending from said corner along the first and second edges for first and second distances to create a layered iso-stress portion at said corner;

the iso-stress elements defining a plurality of edges shaped to be generally aligned with corresponding ones of said iso-stress lines; and a plurality of said first and second distances being greater than 25% of the first and second lengths, respectively.

21. The sail structure according to claim 20 wherein the iso-stress elements are laminated between first and second layers of said sail body material.

22. A method for making a composite iso-stress sail structure comprising:

selecting a chosen sail shape for a sail body, said sail body comprising first and second edges extending from a corner, said first and second edges having first and second lengths;

determining a plurality of expected iso-stress lines for the sail shape when under at least one loading within a chosen range of loadings;

constructing the sail body so to comprise an iso-stress portion to create a composite iso-stress sail structure at said iso-stress portion, the iso-stress portion comprising a plurality of edges shaped to be at least generally parallel to corresponding ones of said iso-stress lines; and said constructing step comprising:

choosing a sail body material and a plurality of iso-stress elements for constructing said iso-stress portion, said iso-stress elements defining a plurality of edges;

shaping edges of said iso-stress elements to generally correspond to corresponding ones of said iso-stress lines;

layering at least some of said plurality of iso-stress elements one on top of one other;

aligning the edges of said iso-stress elements to be at least generally parallel to corresponding ones of said iso-stress lines;

extending at least one said iso-stress element from the corner along the first and second edges for first and second distances;

laminating the sail body material and the at least one said iso-stress element to create said sail body with said iso-stress portion; and selecting at least one of said first and second distances to be at least 20% of the first and second lengths, respectively.

23. The method according to claim 22 wherein the selecting step is carried out so that at least one of said first and second distances is greater than 25% of the first and second lengths, respectively.

24. The method according to claim 22 wherein the selecting step is carried out so that both of said first and second distances are greater than 20% of the first and second lengths, respectively.

25. The method according to claim 22 wherein the selecting step is carried out so that both of said first and second distances are greater than about 25% of the first and second lengths, respectively.

26. The method according to claim 22 wherein the selecting step is carried out so that at least one of said first and second distances is 20–60% of the first and second lengths, respectively.

27. The method according to claim 22 wherein the selecting step is carried out so that at least one of said first and second distances is about 25–60% of the first and second lengths, respectively.

28. The method according to claim 22 wherein the selecting step is carried out so that both of said first and second distances are 20–60% of the first and second lengths, respectively.

29. The method according to claim 22 wherein the selecting step is carried out so that the both of said first and second distances are about 25–60% of the first and second lengths, respectively.

30. The method according to claim 22 wherein the method is directed to making a chosen one of a sailboat sail structure and a sailboard sail structure.

31. The method according to claim 22 wherein said selecting step is carried out so said sail body has a corner and said constructing step is carried out so that each of the iso-stress elements extends from said corner.

32. The method according to claim 22 wherein the edge of aligning step is carried out so that the edges are effectively aligned with corresponding ones of said iso-stress lines.

33. The method according to claim 22 wherein the choosing step comprises obtaining a sail body material comprising layers of sail fabric and said laminating step comprises laminating said iso-stress elements between the layers of said sail fabric.

34. The method according to claim 22 wherein the choosing step is carried out by obtaining a polymer sheet-type sail body material and the laminating step comprises laminating the iso-stress elements to the polymer sheet.

35. The method according to claim 22 wherein the selecting step comprises choosing a sail body having a flat, two-dimensional shape.

36. The method according to claim 22 wherein the selecting step comprises choosing a sail body having a curved, three-dimensional shape.

37. The method according to 36 wherein the selecting step comprises choosing a sail body of a one-piece, molded construction.

38. The method according to claim 36 wherein the selecting step comprises choosing a sail body of a multi-piece construction of sail body elements.

39. The method according to claim 38 wherein the selecting step is carried out with sail body elements being flat, two-dimensional elements prior to being constructed to form the sail body.

40. A method for making a composite iso-stress sail structure comprising:

selecting a chosen sail shape for a sail body, the sail body having a corner and first and second edges extending from the corner, said first and second edges having first and second lengths;

determining a plurality of expected iso-stress lines for the sail shape when under at least one loading within a chosen range of loadings;

constructing the sail body from sail body material and a plurality of layered iso-stress elements associated with the sail body material and extending from said corner to create a layered iso-stress portion at said corner; and said constructing step comprising:

shaping the edges of said iso-stress elements to generally correspond to said iso-stress line; and aligning the edges of said iso-stress elements to be generally aligned with corresponding ones of said iso-stress lines;

extending each of the iso-stress elements from the corner along the first and second edges for first and second distances;

laminating the sail body material and the iso-stress elements to create said sail body with said iso-stress portion; and selecting at least one of said first and second distances to be at least about 25% of the first and second lengths, respectively.

41. The method according to claim 40 wherein the laminating step is carried out by laminating the iso-stress elements between first and second layers of said sail body material.

* * * * *